United States Patent [19]

Jacobsen

[11] 4,358,863

[45] Nov. 16, 1982

[54] SHOWER ENCLOSURE

[76] Inventor: Ralph E. Jacobsen, Mountain Rd., Stowe, Vt. 05672

[21] Appl. No.: 97,732

[22] Filed: Nov. 26, 1979

[51] Int. Cl.[3] ..... A47K 3/14; A47H 15/04; E05D 15/06

[52] U.S. Cl. ..... 4/607; 4/610; 16/96 R; 49/411

[58] Field of Search ..... 4/552, 557, 596, 605, 4/607, 610, 609; 16/90, 91, 96 R, 93 R; 49/408–411, 428, 431; 308/3.6

[56] References Cited

U.S. PATENT DOCUMENTS

| | | | |
|---|---|---|---|
| 1,332,989 | 3/1920 | Layeax | 49/411 X |
| 1,507,670 | 9/1924 | Eisele | 4/607 X |
| 2,911,654 | 11/1959 | Bruno | 4/607 |
| 3,021,576 | 2/1962 | Conroy | 4/607 X |
| 3,074,077 | 1/1963 | Taubman | 4/607 |
| 3,188,699 | 6/1965 | Walters | 4/607 X |
| 3,359,573 | 12/1967 | Casebolt | 4/607 |
| 3,955,239 | 5/1976 | Grossman | 16/96 R |
| 3,975,862 | 8/1976 | Doan | 16/96 R X |
| 4,090,265 | 5/1978 | Baus | 4/607 |

FOREIGN PATENT DOCUMENTS

| | | | |
|---|---|---|---|
| 1097762 | 2/1955 | France | 49/411 |
| 1186714 | 2/1959 | France | 49/411 |

*Primary Examiner*—Stuart S. Levy

[57] ABSTRACT

A shower enclosure comprising a pair of sliding doors mounted on an overhead track, a guide system for the doors spaced downwardly from the overhead track yet providing sufficient head room for a person to enter the enclosed area, the guide system including three guide rails in which one guide rail is disposed between the doors, one guide rail disposed adjacent the inner door, and one guide rail disposed adjacent the outer door, the pair of doors being unguided at the bottom thereof. A single splash rail is mounted on the bottom of the enclosure spaced outwardly from the doors to inhibit leakage from the enclosed area.

6 Claims, 3 Drawing Figures

SHOWER ENCLOSURE

BACKGROUND OF THE INVENTION

1. Field of the Invention

This invention relates to enclosures for showers, tubs or the like.

2. Discussion of Related Art

Normally, sliding door type enclosures used for shower and bathing facilities are produced with suspended doors which slide on a top rail. A bottom rail is mounted on the tub or floor of the enclosed area and contains guide rails for maintaining the doors in vertical orientation, laterally spaced from each other. Such a configuration is shown in U.S. Pat. No. 3,188,699, issued June 15, 1965 to Walters; U.S. Pat. No. 3,359,573, issued Dec. 26, 1967 to Casebolt; and again in U.S. Pat. No. 3,074,077, issued Jan. 22, 1963 to Taubman. This type of guide rail system is plagued with the deficiency that cleaning of the lower guide rails is virtually impossible with the doors in place and even difficult with the doors removed.

Other type guide systems have been suggested in order to cure this deficiency. Included among these is the system shown in U.S. Pat. No. 4,090,265, issued May 23, 1978 to Baus, which shows a partition wall for wet chambers wherein the lower guide rail structure is produced in a stepped fashion. The door bottoms are held in alignment with the steps by use of permanent magnets. Such a system is expensive to manufacture and inconvenient to use.

SUMMARY OF THE INVENTION

One object of the present invention is to provide a shower enclosure having sliding doors which are accurately guided along predetermined paths parallel to each other by guide tracks.

Another object of the present invention is to provide a shower enclosure wherein the guide tracks are not prone to the accumulation of dirt and debris.

Another object of the present invention is to provide a shower enclosure including a lower retaining wall to insure the containment of moisture in the shower being enclosed.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
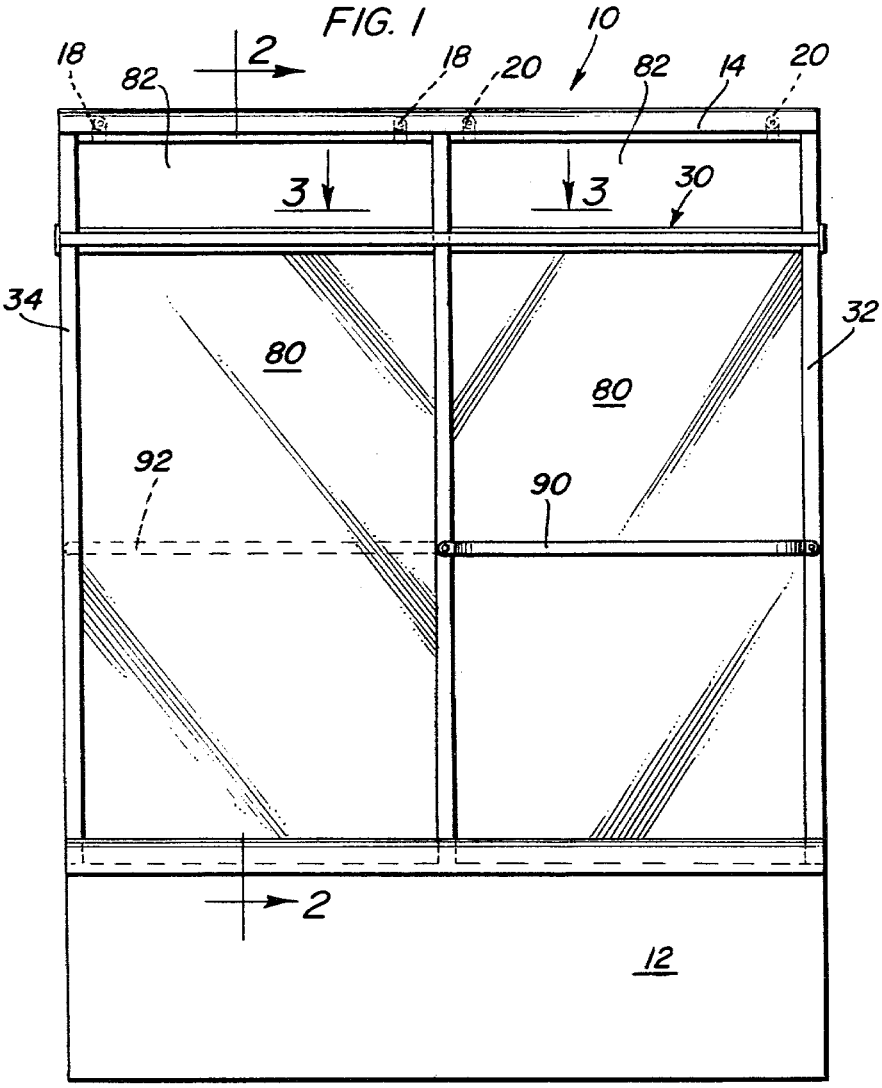
FIG. 1 is a front elevational view of a shower enclosure incorporating the present invention.
Figure 2:
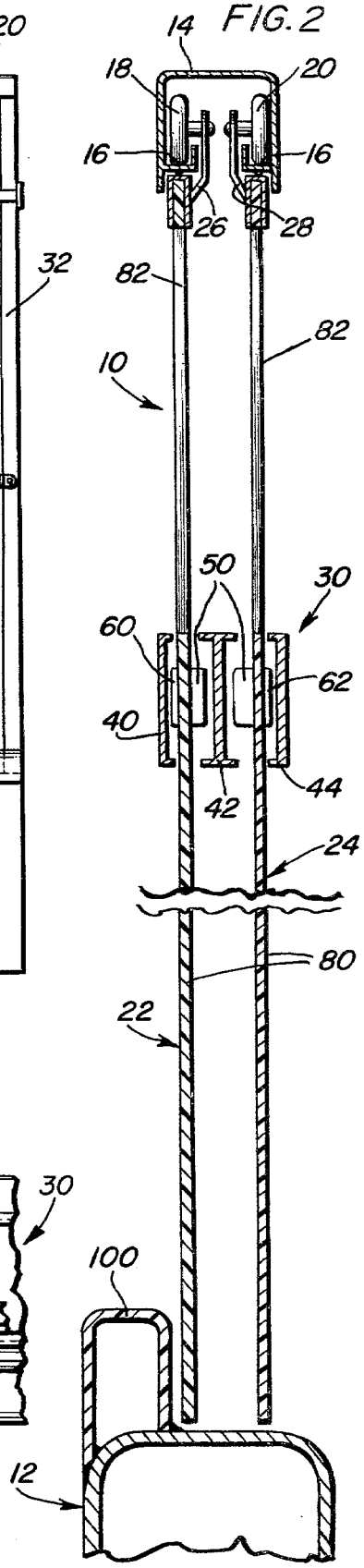
FIG. 2 is a transverse elevational sectional view taken substantially along a plane passing through section line 2—2 of FIG. 1.
Figure 3:
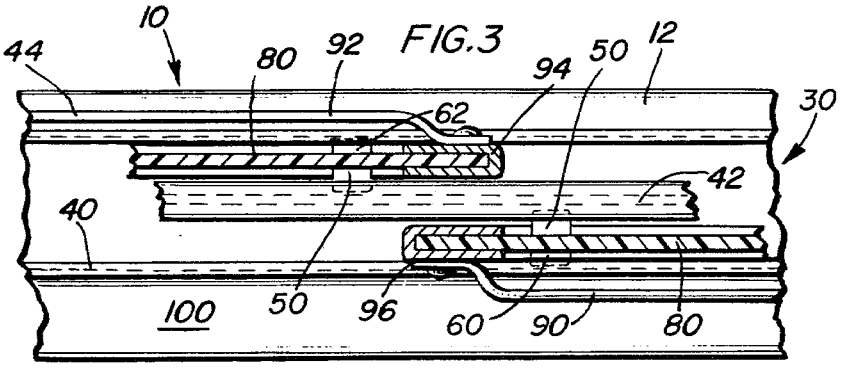
FIG. 3 is a top plan sectional view taken substantially along a plane passing through section line 3—3 of FIG. 1.

Now with reference to the drawings, a shower enclosure incorporating the principles and the concepts of the present invention and generally referred to by the reference numeral 10 will be described in detail. Initially, it should be noted that while the enclosure 10 is shown being used on a conventional bathtub 12 to enclose the interior of the tub for shower purposes, enclosure 10 is also usable in other environments such as a shower stall, if desired.

The enclosure 10 includes a top rail 14 of conventional design having a downwardly opening channel portion and angular runners 16 extending inwardly from the legs of the channel. Each runner 16 supports a pair of guide wheels 18, 20 which are mounted directly over doors 22, 24 respectively on offset mounts 26, 28. This portion of the invention is conventional and used in many existing enclosures.

A guide rail system 30 extends between a pair of uprights 32 and 34 and is spaced below the top rail 14 a sufficient distance to stabilize sliding doors 22 and 24 but are spaced sufficiently above tub 12 to insure ease of entry and exit by a user of the shower stall. The guide rail system 30 includes an outer guide rail 40, a central guide rail 42 and an inner guide rail 44. Guide rail 42 is disposed between doors 22 and 24 and extends for the entire length of their travel. Guide rail 42 is I-shaped in configuration with upper and lower stiffening flanges and a central planar portion which engages bearing surfaces 50 on the doors. The outer guide rail 40 is channel-shaped opening inwardly toward door 22 with its planar bight portion bearing against bearing surface 60 which is attached to the door. In a similar fashion, rail 44 is channel-shaped and opens outwardly toward door 25 with a planar bight portion against which a bearing surface 62 is disposed. Each of the guide rails can be made from extruded aluminum, stainless steel, plastic or any other suitable material, as desired. The bearing surfaces 50, 60 and 62 are preferably formed as nylon skids for ease of sliding.

The doors 22, 24 themselves are preferably produced with lower portions 80 of frosted glass or plastic, the upper portions of the doors above the guide rail system 30 being open for ventilation as indicated at 82. Towel racks 90 92 are provided toward the vertical center of each door facing in opposite directions on their respective doors to facilitate door movement and to hold towels, face cloths, or the like. The towel bars 90, 92 are attached to frameworks 94, 96 which surround the glass 80 of the doors. The frameworks can also be produced from metal or the like, as desired.

Finally, a splash guard 100 is attached by means of gluing or the like to the upper edge of tub 12. Splash guard 100 forms a continuous seal with the top edge of tub 12 and is formed as a channel section with both legs attached to the tub to inhibit the egress of water while one is taking a shower or bath. It will be noted that the splash guard 100 has no crevasses which are difficult to reach and can thus be cleaned easily. Further, the guide system 30 has no channels which can be filled with water to accumulate dirt. Also, in view of the open top and bottom of the guide system 30, it can be cleaned with relative ease.

The foregoing is considered as illustrative only of the principles of the invention. Further, since numerous modifications and changes will readily occur to those skilled in the art, it is not desired to limit the invention to the exact construction and opertion shown and described, and accordingly, all suitable modifications and equivalents may be resorted to, falling within the scope of the invention.

What is claimed as new is as follows:

1. A shower enclosure structure for confinement within the interior of a bathtub comprising; a continuous top rail extending along one surface of the area of the bathtub to be enclosed, a pair of wheel tracks attached to said top rail, a pair of sliding doors, each of which includes support wheels, the support wheels of each door being received in one of said tracks, said top rail extending along the entire width of said pair of sliding doors, and a guide rail system spaced vertically below said top rail and adjacent the upper portion of the sliding doors, said guide rail system including stabilizing means for stabilizig said doors in parallel vertical planes, said stabilizing means including a first guide rail disposed between said pair of sliding doors, an outer guide rail disposed outside said enclosure adjacent the outer surface of one of said doors, and an inner guide rail disposed within said enclosure adjacent the inner surface of the other of said doors, said guide rails extending along the width of the sliding doors for attachment to walls of the enclosure.

2. The enclosure as defined in claim 1 and further including a splash rail disposed along the bottom of said doors and spaced below said guide rail system by a distance to allow ease of entry into said enclosure.

3. The enclosure as defined in claim 3 wherein said enclosed area includes the interior of a bathtub and said splash rail is mounted along one portion of the upper edge of said bathtub.

4. The enclosure as defined in claim 3 wherein each of said doors has an open area for ventilation disposed above said guide rail system and includes a translucent barrier below said guide rail system.

5. The enclosure as defined in claim 4 wherein said guide rail system further includes skid means attached to each of said doors for abutting said guide racks.

6. A shower enclosure confined within the interior of a bathtub comprising; a continuous top rail extending along one surface of the area of the bathtub to be enclosed, a pair of wheel tracks attached to said top rail, a pair of sliding doors, each of which includes support wheels, the support wheels of each door being received in one of said tracks, said top rail extending along the entire width of said pair of sliding doors, and a guide rail system spaced vertically below said top rail and adjacent the upper portion of the sliding doors, said guide rail system including stabilizing means for stabilizing said doors in parallel vertical planes, said stabilizing means including a first guide rail disposed between said pair of sliding doors, an outer guide rail disposed outside said enclosure adjacent the outer surface of one of said doors, and an inner guide rail disposed within said enclosure adjacent the inner surface of the other of said doors, said shower enclosure further including a splash rail mounted along one portion of the upper edge of said bathtub and spaced below said guide rail system by a distance to allow ease of entry into sid shower enclosure, said doors having an openarea for ventilation disposed above said guide rail system and include a translucent barrier below said guide rail system.

* * * * *